US008395530B2

(12) United States Patent
Al-Hasan

(10) Patent No.: US 8,395,530 B2
(45) Date of Patent: Mar. 12, 2013

(54) TRAFFIC CONTROL SYSTEM

(76) Inventor: Khaled Jafar Al-Hasan, South of Surra (KW)

( * ) Notice: Subject to any disclaimer, the term of this patent is extended or adjusted under 35 U.S.C. 154(b) by 375 days.

(21) Appl. No.: 12/721,890

(22) Filed: Mar. 11, 2010

(65) Prior Publication Data

US 2011/0221614 A1 Sep. 15, 2011

(51) Int. Cl.
*G08G 1/095* (2006.01)

(52) U.S. Cl. ..... 340/907; 340/901; 340/902; 340/903; 340/905; 340/906; 340/909; 340/910; 340/916; 340/917; 340/919; 340/928; 340/929

(58) Field of Classification Search ..... 340/901, 340/902, 903, 905, 906, 907, 909, 910, 916, 340/917, 919, 928, 929
See application file for complete search history.

(56) References Cited

U.S. PATENT DOCUMENTS

| | | | | | |
|---|---|---|---|---|---|
| 574,834 | A | * | 1/1897 | Tobin | 137/364 |
| 1,408,982 | A | * | 3/1922 | Calhoun | 404/26 |
| 1,639,495 | A | * | 8/1927 | Frame | 404/26 |
| 2,124,763 | A | * | 7/1938 | Clark | 220/284 |
| 2,883,644 | A | * | 4/1959 | Barker | 340/916 |
| 3,003,471 | A | * | 10/1961 | Bodem et al. | 91/402 |
| 3,010,598 | A | * | 11/1961 | Foss | 220/4.26 |
| 3,106,695 | A | * | 10/1963 | Baltayan et al. | 340/916 |
| 3,196,386 | A | * | 7/1965 | Calderoni et al. | 340/916 |
| 3,390,224 | A | * | 6/1968 | Wyatt | 174/37 |
| 3,392,640 | A | * | 7/1968 | Zeile, Jr. | 404/26 |
| 3,519,726 | A | * | 7/1970 | Ewing | 174/37 |
| 3,550,078 | A | * | 12/1970 | Long | 340/906 |
| 3,672,103 | A | * | 6/1972 | Kost | 52/20 |
| 3,728,464 | A | * | 4/1973 | Griffing | 174/16.1 |
| 3,739,332 | A | * | 6/1973 | Martinez | 340/919 |
| 3,799,036 | A | * | 3/1974 | Slaughter | 92/14 |
| 3,847,496 | A | * | 11/1974 | Stankiewicz | 404/1 |
| 3,972,440 | A | * | 8/1976 | Warren | 220/484 |
| 4,236,358 | A | * | 12/1980 | Bowman | 52/19 |
| 4,570,397 | A | * | 2/1986 | Creske | 52/126.6 |
| 4,592,673 | A | * | 6/1986 | Lee | 404/1 |
| 4,622,435 | A | * | 11/1986 | Trainor et al. | 174/57 |
| 4,655,913 | A | * | 4/1987 | Boersma | 210/163 |
| 4,704,610 | A | * | 11/1987 | Smith et al. | 340/906 |
| 4,775,865 | A | * | 10/1988 | Smith et al. | 340/906 |
| 4,847,618 | A | * | 7/1989 | Baustin | 340/929 |
| 4,976,568 | A | * | 12/1990 | Hess | 404/26 |

(Continued)

FOREIGN PATENT DOCUMENTS

| | | | |
|---|---|---|---|
| CH | 686790 | A5 * | 6/1996 |
| FR | 1259125 | * | 4/1961 |

(Continued)

*Primary Examiner* — George Bugg
*Assistant Examiner* — Paul Obiniyi
(74) *Attorney, Agent, or Firm* — Lowe Hauptman Ham & Berner, LLP

(57) ABSTRACT

A traffic control system for converting an intersection into a roundabout during periods of heavy traffic includes a mechanism for monitoring traffic flow through the intersection and about the roundabout. The system also includes a concave opening in and around the intersection and a concrete disc disposed in the cavity, a hydraulic lift is constructed and arranged to elevate the concrete disc above the level of the road and lights provided to alert motor vehicles to enter a roundabout defined by the elevated disc. The system also includes traffic lights for alerting a motor vehicle operator to drive onto the disc or around the disc to use the intersection and/or roundabout.

2 Claims, 4 Drawing Sheets

U.S. PATENT DOCUMENTS 5,092,705 A * 3/1992 Raswant ..... 404/1
5,114,271 A * 5/1992 Sunderhaus et al. ..... 405/52
5,143,478 A * 9/1992 Bowman ..... 404/26
5,172,113 A * 12/1992 Hamer ..... 340/907
5,257,194 A * 10/1993 Sakita ..... 701/117
5,345,232 A * 9/1994 Robertson ..... 340/906
5,362,175 A * 11/1994 Begin ..... 404/26
5,423,447 A * 6/1995 Youngs ..... 220/254.8
5,594,201 A * 1/1997 Reinert, Sr. ..... 174/37
5,677,684 A * 10/1997 McArthur ..... 340/906
5,777,564 A * 7/1998 Jones ..... 340/917
5,795,095 A * 8/1998 Heller ..... 404/1
5,801,646 A * 9/1998 Pena ..... 340/902
5,880,682 A * 3/1999 Soulliard et al. ..... 340/907
5,917,432 A * 6/1999 Rathbone ..... 340/907
5,926,114 A * 7/1999 Andrews ..... 340/909
5,940,010 A * 8/1999 Sasaki et al. ..... 340/901
5,996,612 A * 12/1999 Crawford ..... 137/371
6,007,270 A * 12/1999 Bowman ..... 404/25
6,064,319 A * 5/2000 Matta ..... 340/917
6,232,889 B1 * 5/2001 Apitz et al. ..... 340/906
6,317,058 B1 * 11/2001 Lemelson et al. ..... 340/910
6,470,633 B2 * 10/2002 Showen ..... 52/169.1
6,597,293 B1 * 7/2003 Harrison ..... 340/944
6,633,238 B2 * 10/2003 Lemelson et al. ..... 340/909
6,696,977 B2 * 2/2004 Thompson et al. ..... 340/905
6,698,973 B2 * 3/2004 Suatac ..... 404/26
6,811,350 B2 * 11/2004 Nadasde ..... 404/26
7,135,989 B2 * 11/2006 Parsons ..... 340/907
7,151,468 B2 * 12/2006 Cummings et al. ..... 340/903
7,165,911 B2 * 1/2007 Fier ..... 404/26
7,236,102 B2 * 6/2007 Shimotani ..... 340/917
7,317,406 B2 * 1/2008 Wolterman ..... 340/917
7,397,390 B2 * 7/2008 DiPiazza ..... 340/905
7,425,104 B2 * 9/2008 Buteliauskas ..... 404/1
7,588,344 B2 * 9/2009 Reinert, Sr. ..... 362/153
7,639,159 B2 * 12/2009 McNew et al. ..... 340/916
7,860,639 B2 * 12/2010 Yang ..... 701/117
7,868,783 B2 * 1/2011 Bachelder ..... 340/906
7,887,251 B1 * 2/2011 Wang ..... 404/25
7,887,252 B1 * 2/2011 Wang ..... 404/25
7,898,432 B2 * 3/2011 McNew et al. ..... 340/916
8,068,036 B2 * 11/2011 Ghazarian ..... 340/903
8,094,040 B1 * 1/2012 Cornett et al. ..... 340/902
2002/0008637 A1 * 1/2002 Lemelson et al. ..... 340/907
2002/0018004 A1 * 2/2002 Raswant ..... 340/907
2002/0025223 A1 * 2/2002 Suatac ..... 404/26
2002/0076276 A1 * 6/2002 Troemel et al. ..... 404/1
2003/0016143 A1 * 1/2003 Ghazarian ..... 340/901
2003/0210156 A1 * 11/2003 Nishimura ..... 340/907
2004/0184879 A1 * 9/2004 Winkler ..... 404/1
2005/0156757 A1 * 7/2005 Garner ..... 340/907
2005/0206728 A1 * 9/2005 Janssen ..... 348/149
2005/0231384 A1 * 10/2005 Shimotani ..... 340/903
2005/0280553 A1 * 12/2005 DiPiazza ..... 340/905
2006/0071814 A1 * 4/2006 Cummings et al. ..... 340/903
2006/0071815 A1 * 4/2006 Parsons ..... 340/916
2006/0078381 A1 * 4/2006 Fier ..... 404/26
2006/0099029 A1 * 5/2006 Hazan ..... 404/1
2006/0181433 A1 * 8/2006 Wolterman ..... 340/917
2007/0258759 A1 * 11/2007 Buteliauskas ..... 404/1
2008/0122653 A1 * 5/2008 Chen ..... 340/907
2008/0266136 A1 * 10/2008 Diba ..... 340/906
2008/0284616 A1 * 11/2008 Rendon ..... 340/907
2009/0035058 A1 * 2/2009 Berman et al. ..... 404/1
2009/0135026 A1 * 5/2009 Lee ..... 340/941
2009/0224942 A1 * 9/2009 Goudy et al. ..... 340/905
2009/0241435 A1 * 10/2009 Suatac ..... 52/19
2009/0267801 A1 * 10/2009 Kawai et al. ..... 340/988
2009/0322561 A1 * 12/2009 Morioka et al. ..... 340/907
2010/0060483 A1 * 3/2010 McNew et al. ..... 340/907
2010/0207786 A1 * 8/2010 Chen et al. ..... 340/903
2010/0214126 A1 * 8/2010 Publicover ..... 340/907
2011/0006914 A1 * 1/2011 Tsuda ..... 340/905
2011/0012757 A1 * 1/2011 Pashel ..... 340/906
2011/0109477 A1 * 5/2011 Edwardson et al. ..... 340/906
2011/0109478 A1 * 5/2011 Williamson et al. ..... 340/906
2011/0193722 A1 * 8/2011 Johnson ..... 340/906
2011/0205086 A1 * 8/2011 Lamprecht et al. ..... 340/928
2011/0234423 A1 * 9/2011 Edwardson ..... 340/906

FOREIGN PATENT DOCUMENTS

FR 2426299 * 12/1979
GB 2458124 A * 9/2009
JP 2004142164 A * 5/2004
WO WO 9746990 A1 * 12/1997

* cited by examiner

TRAFFIC CONTROL SYSTEM

FIELD OF THE INVENTION

This invention relates to a traffic control system and more particularly to a traffic control system for converting an intersection to be used during periods of light traffic into a roundabout for periods for periods of heavier traffic.

BACKGROUND FOR THE INVENTION

Traffic separators and traffic controls for varying the effective width of a roadway by means of vertically movable traffic separating barriers arranged to divide the traffic into equal or unequal portions are well known and have been in use for many years. For example, a U.S. Pat. No. 2,260,051 of Pardee discloses a traffic separator. A mechanism for providing variable capacity highways is also disclosed in a U.S. Pat.No. 2,287,685 of Jelinek.

A more recent U.S. Pat. No. 4,017,200 of Woods discloses a highway lane divider barrier and apparatus for shifting traffic from one lane to another in order to accommodate different traffic flow patterns for different times of day and different traffic conditions. It has been recognized that many highways that extend to and from urban areas are multiple lane highways and that it is common practice to arrange the direction of flow on such highways to expedite the traffic flow for all conditions. For example, in a six lane roadway it is common to utilize four lanes for traffic flow toward the urban area during morning hours, the other two lanes being for traffic leaving the urban areas, and then, to reverse the traffic flow during the evening hours so that four of the six lanes carry traffic away from the urban area.

The aforementioned approaches to traffic control are and have been effective for speeding up traffic and reducing congestion. However, such approaches have not addressed a serious problem of congestion at traffic intersections. The problem with intersections is that with population growth and an increase in the number of cars on the road, the problems become more and more serious. There are essentially two approaches to relieving traffic congestion at intersections. For example, a stop light can be reprogrammed to provide a much longer green light in a direction of maximum flow. The other approach is to place a police officer in the intersection to direct traffic.

It is now believed that the problem of congestion at an intersection can be reduced by the present invention that converts an intersection into a roundabout during periods of heavy traffic.

BRIEF SUMMARY OF THE INVENTION

In essence, the present invention contemplates a traffic control system for converting an intersection into a roundabout. The system comprises or consists of a traffic monitoring means such as an infrared sensor or pressure plate for detecting cars entering the intersection or roundabout from each road leading into the intersection or roundabout. A concrete disc defining an inner portion of a roundabout is disposed within a recessed cavity in and around an intersection and hydraulic means are provided for elevating the concrete disc out of the cavity and lowering the disc into the cavity in response to a signal from the traffic monitoring means. In addition, the system includes illumination means for illuminating traffic lanes when the disc is in a recessed position and a plurality of traffic lights for indicating the direction of traffic flow into and through the intersection as well as around the roundabout.

The invention will now be described in connection with the following figures wherein like reference numerals have been used to indicate like parts.

DESCRIPTION OF THE PREFERRED EMBODIMENTS OF THE INVENTION

Figure 1:
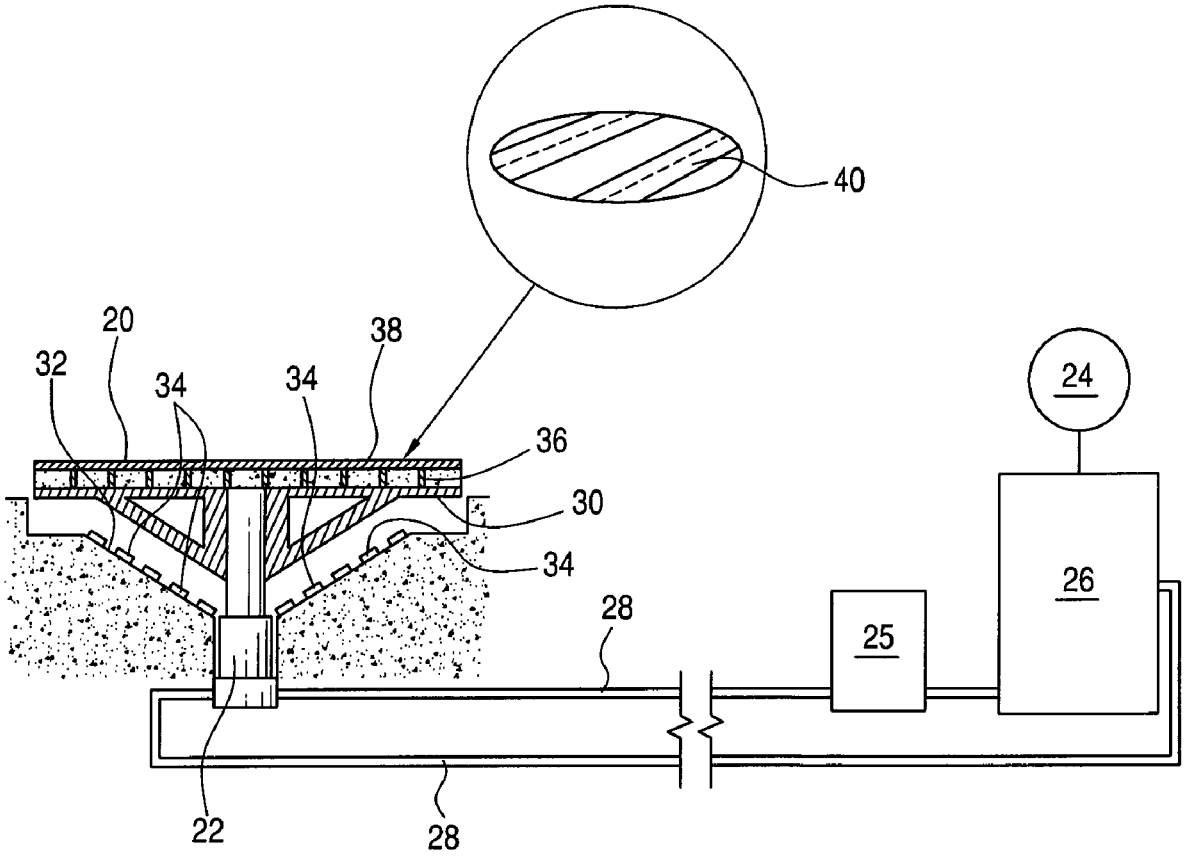
FIG. 1 is a schematic illustration of a traffic control system in accordance with a first embodiment of the invention.

A traffic control system for converting an intersection into a roundabout will now be described with reference to FIG. 1 wherein a concrete disc 20 defines an inner portion of a roundabout upon which motor vehicles are prevented from driving. The disc 20 is elevational above the surface of the roadway as for example by a distance of up to 10 cm. The disc 20 is elevated by means of a hydraulic jack 22 or other suitable means. The jack 22 is raised up or down in response to a control and operation mechanism 26 that is powered by a separate electric generator 24 and a hydraulic pump 25 that pumps hydraulic fluid through the high pressure hydraulic lines 28.

The concrete disc 20 is supported by a metal frame work 30 that fits within a concave opening 32 that includes a plurality of rubber rings 34. The metal framework 30 rests on the rubber rings 34 in order to reduce or eliminate the effects of vibration on the disc 20 when motor vehicles drive over the disc 20 when it is in its recessed position i.e. when the use of the intersection is in effect.

The disc 20 also includes a metal support 36 or grate that may also be positioned on top of the concrete disc and an upper transparent acrylic layer 38 with a thickness of about 10 cm. Initially yellow lines 40 act as lane dividers when the central disc is in its recessed position to provide a conventional intersection but are extinguished when the disc is elevated to convert the intersection to the roundabout to handle heavier traffic.

Figure 2:
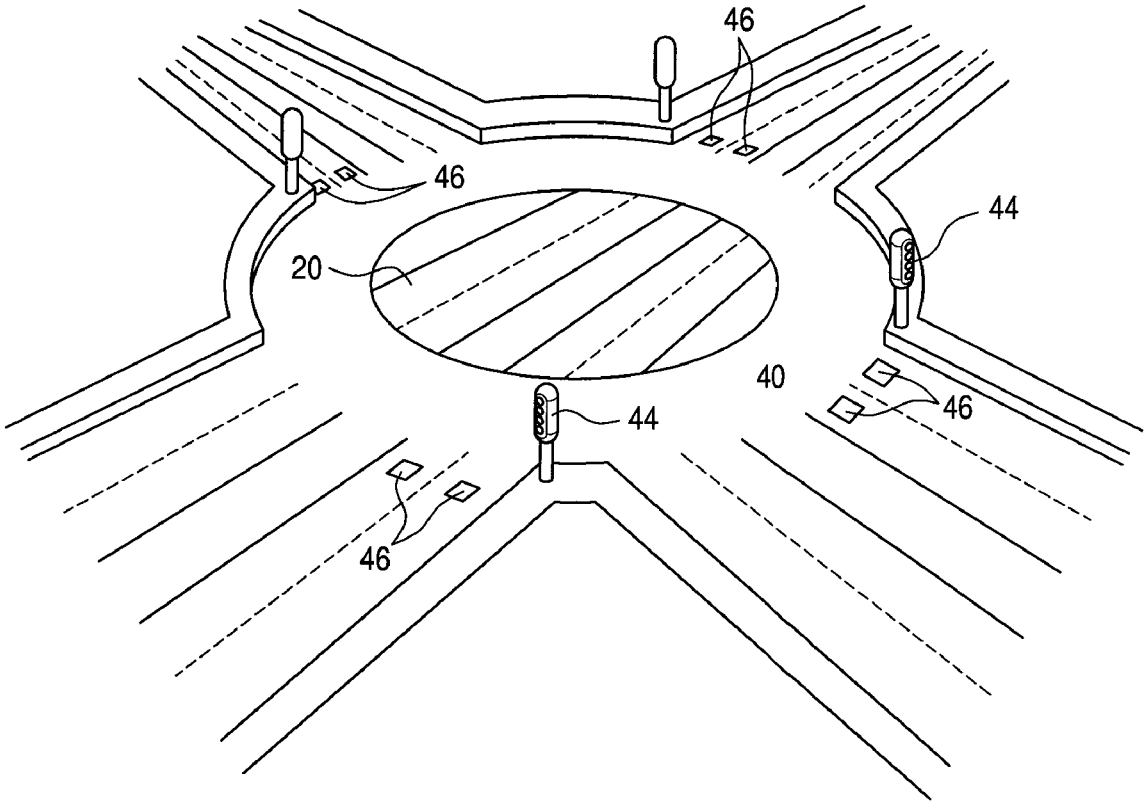
FIG. 2 is a schematic illustration of a traffic control system wherein the control system is operational as a conventional intersection.
Figure 2A:
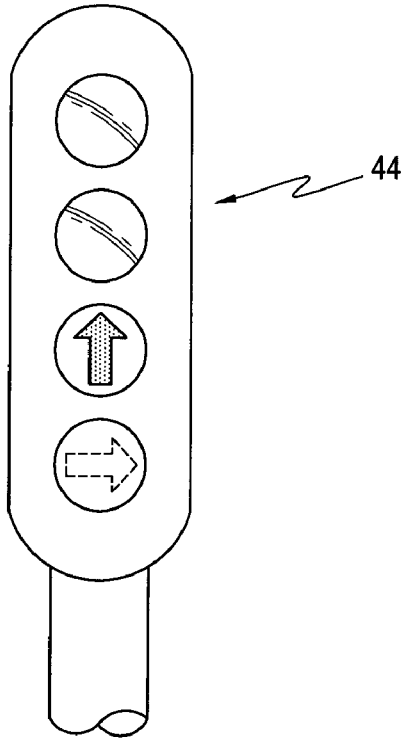
FIG. 2*a* is a schematic illustration of a traffic light with a signal to proceed through the intersection as illustrated in FIG. 2.

In the operation of the traffic control system it is assumed that the disc 20 is in its recessed position so that the corner is operated as a conventional intersection with the illuminated lane markings. The lane markings extend across the elevational disc 20 and are illuminated to direct traffic directly across the disc 20. At this time each of the traffic lights 44 (FIGS. 2*a* and 3*a*) include a vertical arrow on the green light to indicate that the traffic pattern is straight through to an opposite lane.

Figure 3:
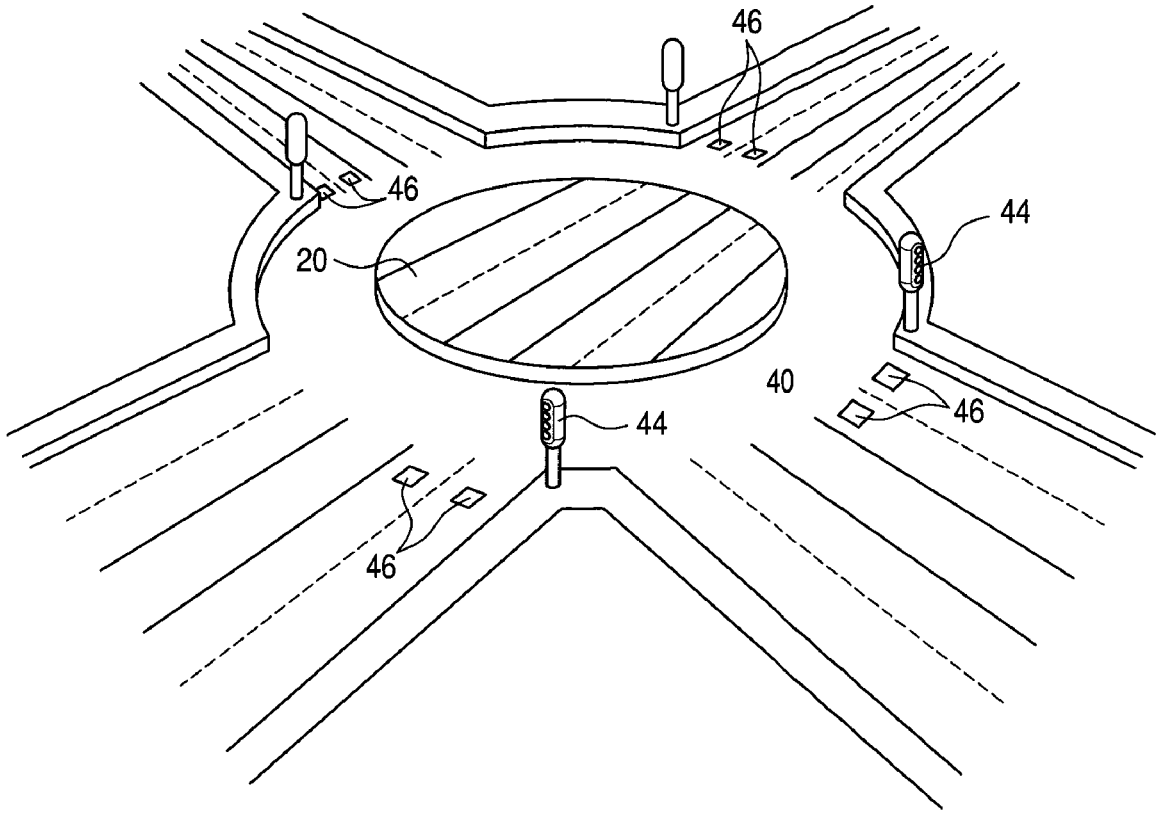
FIG. 3 is a schematic illustration of a traffic control system wherein the control system is operational as a roundabout.
Figure 3A:
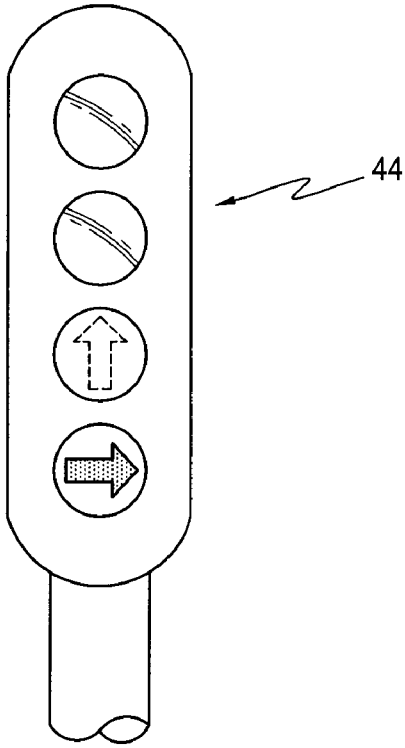
FIG. 3*a* is a schematic illustration of a traffic light with a signal to proceed around a roundabout.
Figure 4:
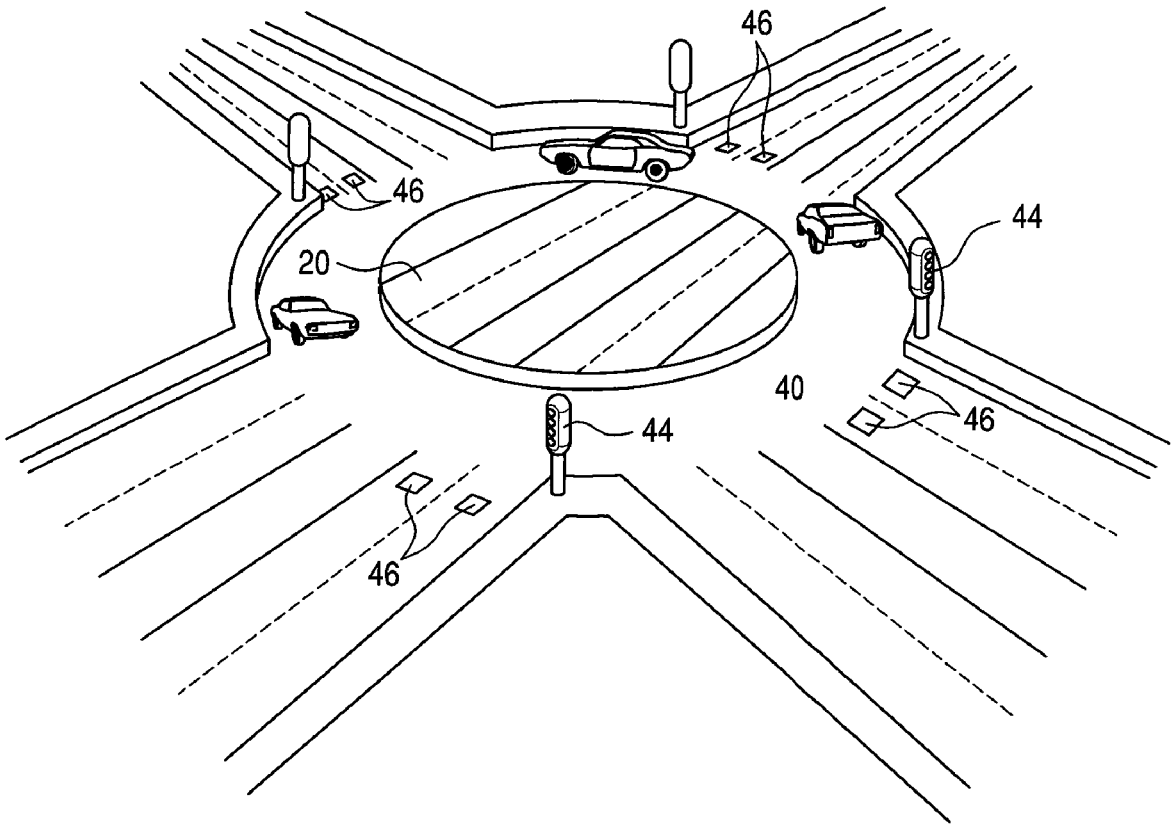
FIG. 4 is a schematic illustration of a traffic control system wherein the control system is operational as a roundabout with motor vehicles operating within the roundabout.

Then when the pressure plates 46 with one at each entrance to the intersection indicate heavier traffic, the traffic lights 48 (see FIGS. 2*a* and 3*a*) turn red and all traffic approaching the intersection comes to a stop. The transformation to a roundabout is then set in motion automatically or manually by pressing a switch (not shown). By pressing a switch, the control and operation mechanism 26 causes the hydraulic fluid in the hydraulic fluid line 28 to flow to thereby raise the disc 20 by means of a jack 22. In this manner, the upper surface 38 is lifted slowly away from the concrete hole and the rubber rings 32 to thereby block through traffic from crossing the disc 20 to reach a road on the opposite side thereof. At the same time the illumination of the through lanes is extinguished. After the transition to a roundabout is complete, the traffic lights 44 illuminate a green light with a generally horizontal arrow directing the operators of motor vehicles to proceed around the roundabout. Lights are also illuminated to show the elevated disc. As illustrated in FIGS. 3 and 4 the disc 20 basically blocks the through lanes connecting opposite roadways while a additional provision provides a concrete element connecting the corners of the roadway to thereby provide a portion of a roundabout.

While the invention has been disclosed in connection with its preferred embodiments it should be recognized that changes and modifications may be made therein without departing from the scope of the claims.

What is claimed is:

1. A traffic control system for converting an intersection into a roundabout, said system comprising:

traffic monitoring means for monitoring a flow of traffic into and through an intersection;

in which said traffic monitoring means includes an infrared detector for detecting motor vehicles entering said intersection; and a pressure plate on each road leading into said intersection to detect the number of cars entering said intersection over time;

a concrete disc defining an inner area of a roundabout disposed in an intersection approximately flush with the roadway leading into and out of the intersection; and which includes a metal disc superimposed on said concrete disc; and a transparent acrylic disc superimposed on said metal disc and illuminable traffic lanes for indicating traffic lanes during normal traffic flow;

means for illuminating traffic lanes when said concrete disc is in a recessed position and means for extinguishing said lane illumination when said disc is elevated;

in which said concave opening in said intersection for recessing said concrete disc includes a plurality of rubber rings around said opening for abutting said concrete disc to reduce vibration therein when said concrete disc is recessed so that traffic flows across the disc and through the intersection;

hydraulic means for elevating said disc in response to a signal from said traffic monitoring means;

which includes illuminated means around the outer periphery of said disc for warning drivers of said disc when said disc is elevated;

means including said hydraulic means for returning said traffic flow to normal by returning said disc to the unelevated position; and a lighting system at the entrance of said intersection/roundabout to warn an operator of a motor vehicle when the intersection is operated as a conventional intersection and when it is operational as a roundabout; and which includes a traffic light at the end of each road leading into said intersection and said roundabout for alerting a driver to the intersection or roundabout.

2. A traffic control system for converting an intersection into a roundabout, said system consisting of:

traffic monitoring means for monitoring a flow of traffic into and out of an intersection and wherein said monitoring means includes an infrared detector or pressure plate on or at each road entering or leaving said intersection;

a concrete disc defining an inner portion of a roundabout disposed in an open cavity in an intersection with a surface approximately flush with said road entering into or leaving out of said intersection and wherein said open cavity includes a plurality of rubber rings for abutting said concrete disc or said support member therefore when said disc is in a recessed position within said opening for eliminating vibration when said disc is in a recessed position within said cavity;

a steel disc and an acrylic layer superimposed on said concrete disc and means for illuminating traffic lanes when said disc is recessed on said cavity;

hydraulic means for elevating said disc in response to a signal from said traffic monitoring means and for lowering said disc in response to a signal from said monitoring means when traffic is light;

which includes illuminated means around the outer periphery of said disc for warning drivers of said disc when said disc is elevated;

means for stopping traffic from entering said intersection or roundabout during the elevation or lowering of said concrete disc;

a traffic light at the end of each road adjacent said disc for alerting a driver of a intersection or a roundabout; and means for illuminating traffic lanes when said disc is recessed in said cavity and for extinguishing said illumination of said traffic lanes when said disc is in an elevated position.

* * * * *